United States Patent [19]

Schwartz

[11] 3,964,360

[45] June 22, 1976

[54] SHEET MATERIAL CUTTING APPARATUS

[76] Inventor: Joseph Schwartz, 841A Heritage Village, Southbury, Conn. 06488

[22] Filed: Dec. 22, 1975

[21] Appl. No.: 643,248

[52] U.S. Cl. ..... 83/464; 83/468; 83/522; 83/565; 83/581; 83/614; 83/700; 83/828

[51] Int. Cl.[2] ..... B26D 3/02; B26D 5/10

[58] Field of Search ..... 83/464, 468, 455, 522, 83/565, 477.2, 581, 614, 700, 827, 828

[56] References Cited

UNITED STATES PATENTS

| | | | |
|---|---|---|---|
| 2,531,149 | 11/1950 | Melchor | 83/455 |
| 2,833,350 | 5/1958 | Merkur | 83/455 |
| 3,370,497 | 2/1968 | Busse | 83/455 |
| 3,897,706 | 8/1975 | Martin | 83/455 |

*Primary Examiner*—Frank T. Yost

*Attorney, Agent, or Firm*—St. Onge Mayers Steward & Reens

[57] ABSTRACT

A mat cutting apparatus is described for cutting sheet material. A cutting board is provided on which a pair of longitudinal guide bars are mounted with a predetermined spacing between them. The spacing is selected to snugly receive a cutting block. The cutting block is formed of a guide block on which a knife assembly is movably mounted. The guide block fits snugly between the guide bars to enable formation of a precision cut when the knife assembly is plunged into a mat to be cut. Several embodiments for cutting mats are shown including straight and angle cutters and a cutter adapted for use with a template.

17 Claims, 12 Drawing Figures

Fig. 3.
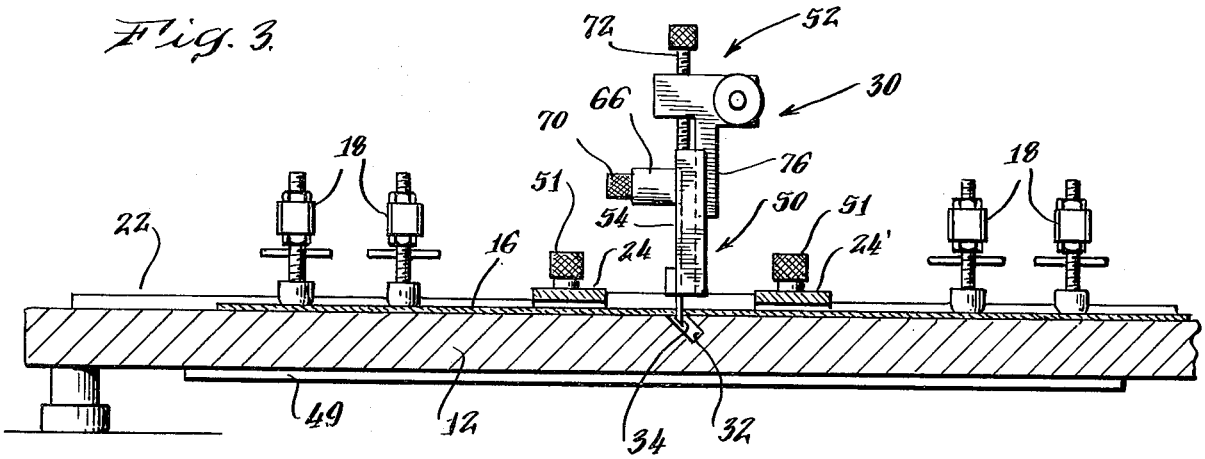
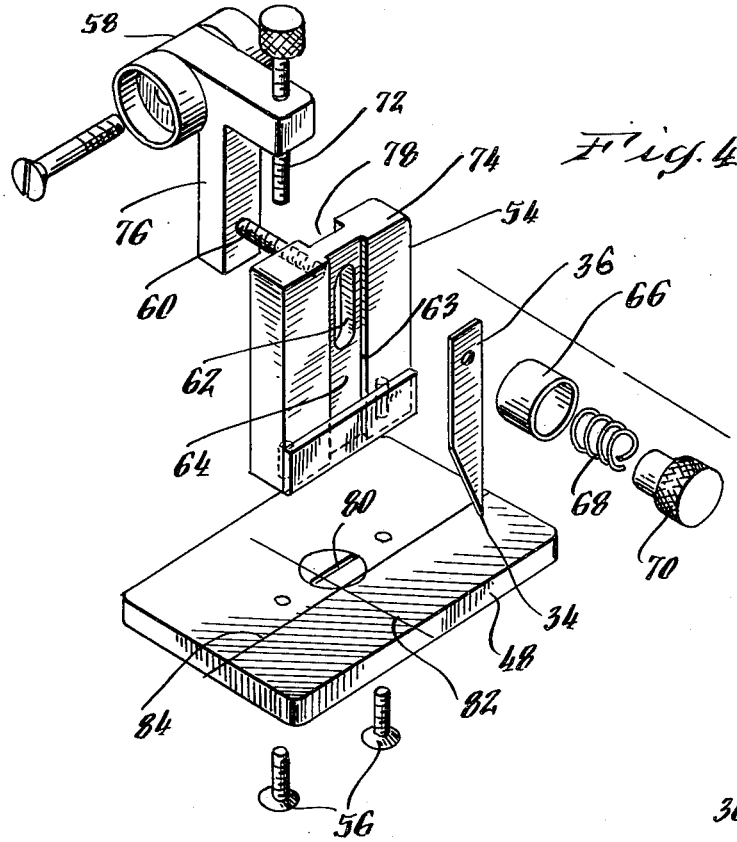
Fig. 4.
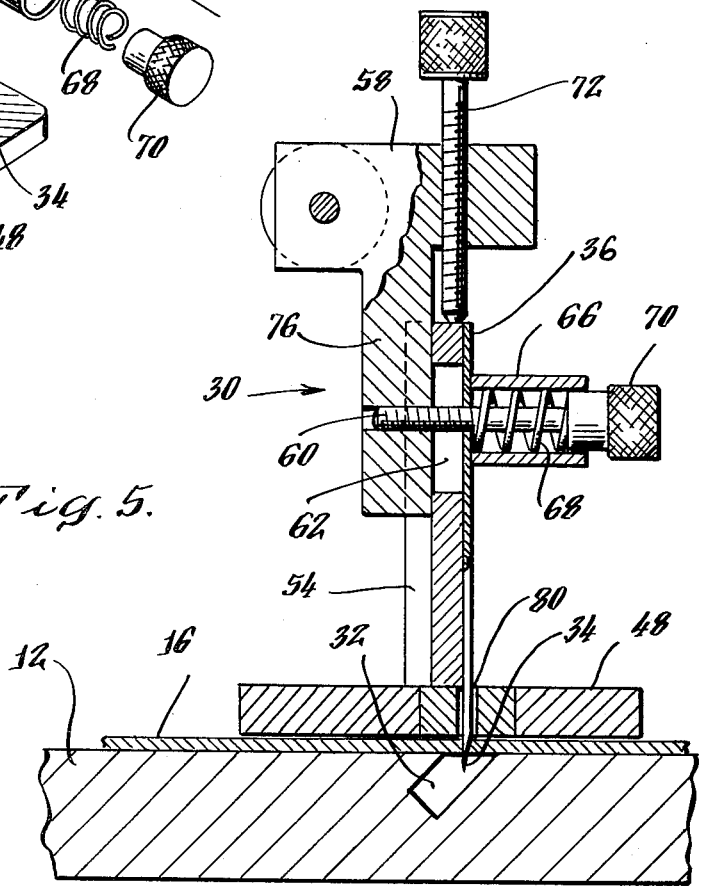
Fig. 5.

SHEET MATERIAL CUTTING APPARATUS

FIELD OF THE INVENTION

This invention generally relates to an apparatus for cutting sheet material. More specifically, this invention relates to an apparatus for cutting mats used to frame pictures.

BACKGROUND OF THE INVENTION

Sheet material cutting devices are known in the art. One such device is described in the U.S. Pat. No. to Keeton, 3,213,736 for cutting mats. The latter mat cutting device employs an elongated tie bar which is supported by end located arms. The arms in turn are pivotally mounted on a working board to lift the tie bar with its cutter elements and place a mat underneath on the working surface. The cutting elements slide along a rail located in the tie bar and are disposed on opposite sides of the tie bar to respectively provide either a straight or beveled cut.

Another sheet material cutting apparatus is described in the patent to Matthew, U.S. Pat. No. 3,774,495. In this patent, a key-shaped cutting arrangement is shown to provide guide surfaces, one of which supports a cutting block. The cutting block is mounted to enclose this guide surface. The material to be cut abuts against a stop plate carrying a scale and a scale is moved along with the cutting block itself.

In the U.S. Pat. No. to Broides, 3,779,119 a mat cutting apparatus is described wherein a cutting element is mounted on a guide rail. Other U.S. patents of interest and describing various devices for cutting sheet material are Wensink, 2,696,867; Melchor, 2,531,149 in connection with a floor tile cutting device; and Katz, 3,576,148 which describes a device for forming a strip mat.

SUMMARY OF THE INVENTION

In a mat cutting apparatus in accordance with the invention, a system is provided with which the cutting of a mat is convenient to carry out in an accurate and neat manner. As described with reference to a preferred embodiment, a mat to be cut is conveniently aligned on a cutting board and held on the board with a number of easily manipulated clamps. The mat is positioned below a pair of guide bars which are affixed to the cutting board. A cutter block is formed with an extended workpiece contacting surface from which a knife edge can protrude for the cutting of the mat. The cutter block fits between the guide bars so that movement of the cutter block can be guided in a precise manner along a desired cut line on the mat.

With a cutter block in accordance with the invention, very thin materials such as aluminum foil, cardboards and sheets of cork may be cut. The term "mat" as employed herein, therefore, is intended to include materials such as aluminum foil, cardboard, sheets of cork and the like.

As described with reference to the preferred embodiment, the guide bars are parallel spaced and affixed with spacers above and to the board. The spacing between the guide bars is selected to snugly receive a cutter block. The cutter block is provided with a flat undersurface to enable smooth engagement with a flat mat while enabling a knife edge to penetrate into the mat from an area generally within a central segment of the cutter block work piece engaging surface. A groove is formed in the cutter board and located between the guide bars to receive the knife edge projecting through the mat from the cutter block. A lateral scale, which is oriented transversely to the guide bars is mounted to the cutter board to serve as a locating edge for a mat to be cut. A scale on one of the guide bars is referenced with respect to the locating edge of the lateral scale to enable precise determination of the mat cut.

As described with reference to the preferred embodiment, the cutter block includes a guide block, which serves to movably support a knife assembly as well as enable smooth sliding motion over a mat. The knife assembly may be moved between a retracted position and a mat cutting position in a convenient, plunging manner at the beginning of a cut. The depth of penetration by the knife may be adjusted in an accurate manner.

The guide block preferably includes a transparent base carrying cross hair lines defining the projected line of travel of the knife edge and its actual lateral position. In this manner the use of the cutter block conveniently involves an initial visual alignment of the cross hair lines through the transparent base with the desired starting place for a mat cut. The knife assembly is then moved from its retracted position and plunged towards the mat to cause the knife edge to protrude from the base and penetrate the mat. Thereupon a firm longitudinal movement of the cutter block over the mat enables the formation of a smooth cut without irregularities.

It is, therefore, an object of the invention to provide a mat cutting apparatus suitable for cutting thin sheet materials such as may be made of cardboard, cork or thin foils and the like. It is a further object of the invention to provide a convenient cutter block for use in connection with a mat cutting apparatus whereby the entire mat cutting operation can be conveniently carried out in an accurate and controlled manner.

These and other advantages and objects of the invention can be understood with reference to the description of a preferred embodiment described in conjunction with the drawings.

BRIEF DESCRIPTION OF DRAWINGS

FIG. 3 is a section view of the mat cutting apparatus shown in FIG. 2 taken along a plane as defined by line 3—3 in FIG. 2;

FIG. 4 is an exploded view of a cutting block for forming rectangular cuts in a mat for use with the apparatus shown in FIGS. 1–3;

FIG. 5 is a section view of a cutting block employed on a mat cutting apparatus as shown in FIG. 1;

DETAILED DESCRIPTION OF EMBODIMENT

Figure 1:
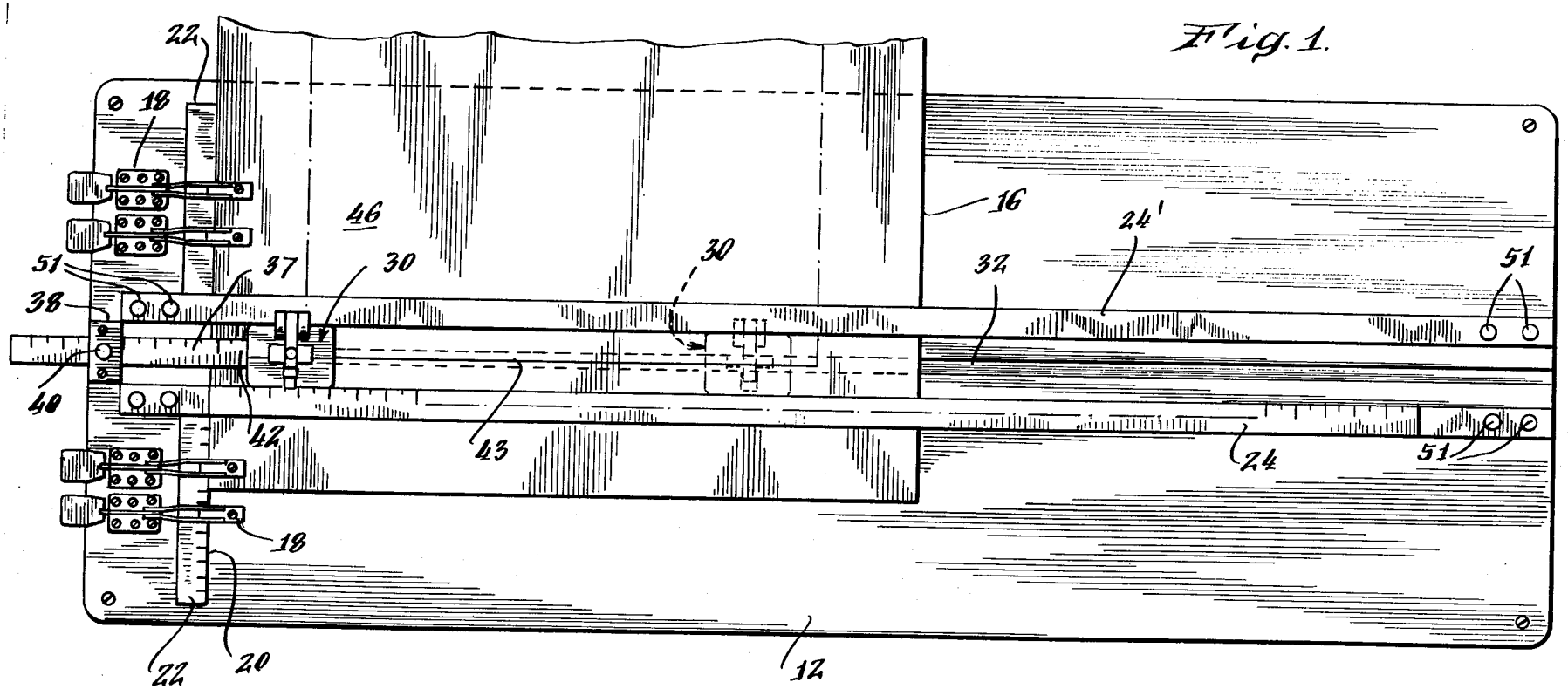
FIG. 1 is a plan view of a mat cutting apparatus in accordance with the invention.
Figure 2:
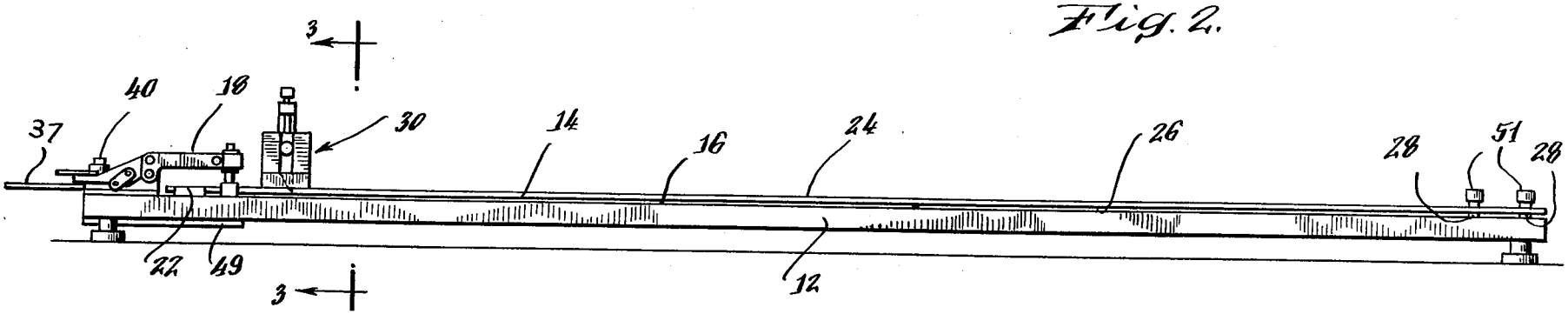
FIG. 2 is a side view in elevation of the mat cutting apparatus shown in FIG. 1.

With reference to FIGS. 1, 2 and 3, a mat cutting apparatus 10 is shown formed with a cutting board 12 having a work surface 14 to cut a sheet material 16 such as mats and the like.

The mat cutting apparatus 10 employs a plurality of clamps 18 mounted on the cutting board 12 to retain mat 16 in alignment against edge 20 of a lateral scale 22. The number and spacings of the clamps 18 can be varied commensurate with the size of the cutting board 12. The clamps 18 are commonly available devices and may be conveniently manually operated. A pair of longitudinal guide bars 24–24′ are mounted in parallel spaced fashion on the cutting board 12. The guide bars 24 are formed of suitable metal bars of sufficient rigidity to be spaced above the cutting board 12 to provide a clearance 26 of sufficient size to fit a mat 16 beneath bars 24. Suitable spacers 28 are employed between bars 24 and cutting board 12 to provide the clearance 26. Spacers 28 may be replaced with spacers of different thickness to vary the clearance 26 as may appear necessary.

The spacing, S, between the parallel guide gars 24–24′ is selected so that the bars 24 can snugly receive a cutter block 30 operating between and along the longitudinal direction of the guide bars 24. A groove 32 in the board 12 is provided and located to extend parallel to and between guide bars 24 to receive a knife edge 34 mounted on a cutter block 30. Lateral scale 22 is precisely perpendicular to guide bars 24 and carries indicia referenced with respect to the cutting edge 34 of the knife 36 in cutter block 30.

An adjustable end stop scale 36 is mounted on cutting board 12 with a retainer 38 which is releasably fastened with a thumb screw 40. The end stop scale 36 extends into the spacing, S, between guide bars 24 to determine a stop location for cutter block 30 with a stop edge 42. By varying the position of scale 36 one can form a cut 43 in a mat in a firm decisive manner by moving the cutter block 30 from its position indicated in phantom at 44 over the mat to the position indicated with full lines at 46 where the base 48 of the cutter block 30 contacts the end stop scale 36.

The mounting of scale 36 and guide bars 34 is done with a template 49 located below cutting board 12. Template 49 is provided with accurately located holes to enable scale 22 to be mounted at exactly ninety degrees relative to guide bars 24 as well as assure that the latter are properly spaced and parallel. Screws such as 51 are used to engage holes in the template 49. A pair of screw 51 are used at each end of a guide bar 24 to reduce pivot action and flexing around end located supports.

As more clearly illustrated in FIGS. 3, 4 and 5, the cutter block 30 is formed of a guide block 50 and a knife assembly 52, which is movably mounted to the guide block 50. The guide block 50 is formed of two segments, a transparent cutter base 48 and a vertically disposed knife guide plate 54 affixed to the base 48 with a pair of flat head screws 56.

The knife assembly 52 includes a knife actuator 58 carrying a knife mounting pin 60 sized to fit through a vertically oriented motion limiting slot 62 formed in the guide plate 54. Slot 62 is located in a knife recess 64 sized and shaped to receive knife 36 to enable it to slide up and down under control by actuator 58. The knife 36 is held in recess 64 with a bushing 66, spring 68 and thumb screw 70 which engages threaded pin 60. The recess 64 is oriented to receive the knife 36 in flush relationship while providing edgewise support in the cutting direction. In this manner the side 63 of recess 64 can support an edge of knife 36 without requiring very high pressure from thumb screw 70 to keep the knife 36 in position. The pressure applied by the thumb screw 70 can be varied so that the knife sliding movement along its recess 64 can be varied with different degrees of difficulty.

The maximum movement of the knife 36 is limited by slot 62. In addition, a depth of penetration control is provided by a threaded adjustable knife stop pin 72 mounted in a threaded hole of actuator 58 to engage an upper surface 74 of the guide plate as shown n FIG. 5. Actuator 58 is provided with a guide extension 76 shaped to fit and slide in a recess 78 of guide plate 54 and located opposite the knife recess 64.

The transparent cutter base 48 is provided with a slot 80 which is preferably just large enough to freely receive the knife edge 34 when it is plunged down to cut a mat 16. The underside of the cutter base 48 is flat and smooth and is provided with visible scribed hairlines 82, 84 which intersect at a point which is coincident with the tip 34 of the knife 36. The hairlines 82, 84 are visible through the transparent base 48 so that precise alignment of knife edge 34 with previously drawn lines on a mat 16 can be made. The shape of the cutter base 48 is preferably rectangular and selected sufficiently large in area to enable convenient movement over a mat. In particular, the base area is selected so that foil materials may be cut without wrinkling. As one example of a suitable area for a cutter base, the dimensions were about 2 × 3 inches and regtangular with rounded corners and a flat, smooth undersurface. It should be understood that variations from such dimensions can be made depending upon the spacing, S, between the guide bars 24 and materials to be cut.

Figure 6:
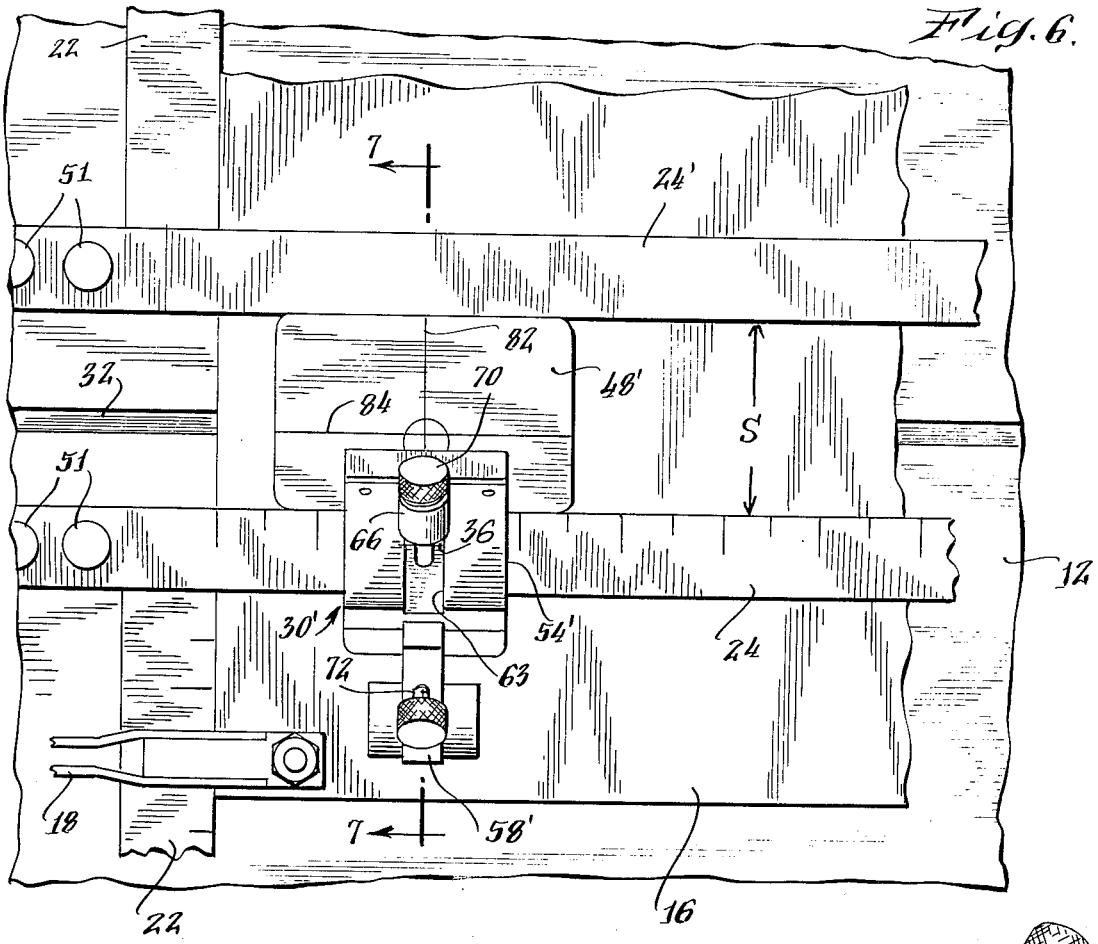
FIG. 6 is a partial plan and enlarged view of a cutting block for forming angle cuts in a mat with an apparatus as shown in FIG. 1.
Figure 7:
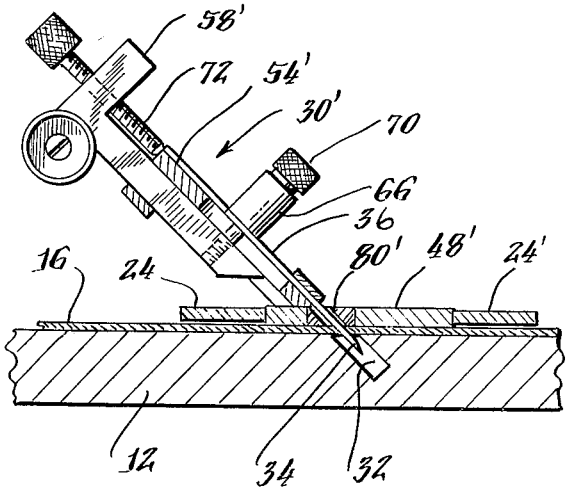
FIG. 7 is a section view of the angle cutter block taken along a plane as defined by line 7—7 as shown in FIG. 6.
Figure 8:
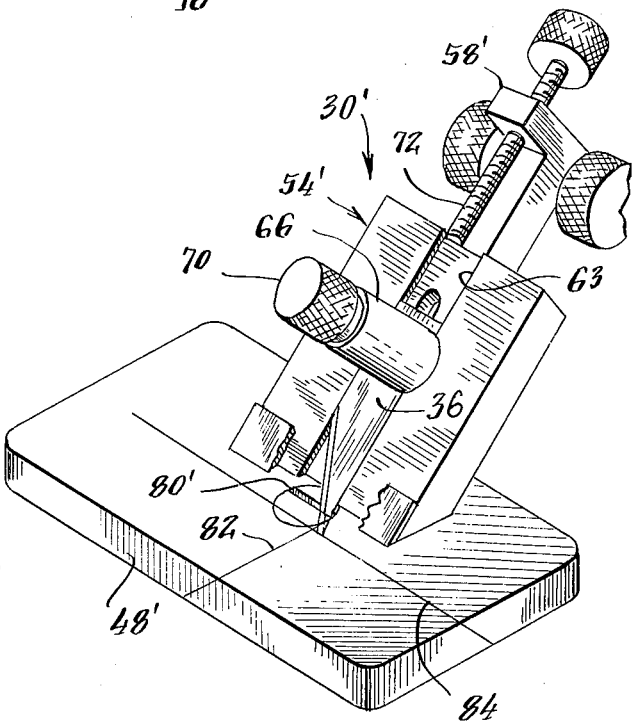
FIG. 8 is a perspective view of the angle cutter block.

With reference to FIGS. 6, 7 and 8, an angle cutter block 30′ for cutting beveled angles is shown mounted between the guide bars 24. The angle cutter block 30′ is formed similar to straight cutting block 30, except that the knife guide plate 54′ is mounted at a 45° angle relative to the cutter base 48′. The orientation of the angle cutter block 30′ is selected so that the knife edge 34 can penetrate the groove 32 in the cutting board as illustrated in FIG. 7. The slot 80′ in the cutter base 48 is correspondingly angled.

Figure 9:
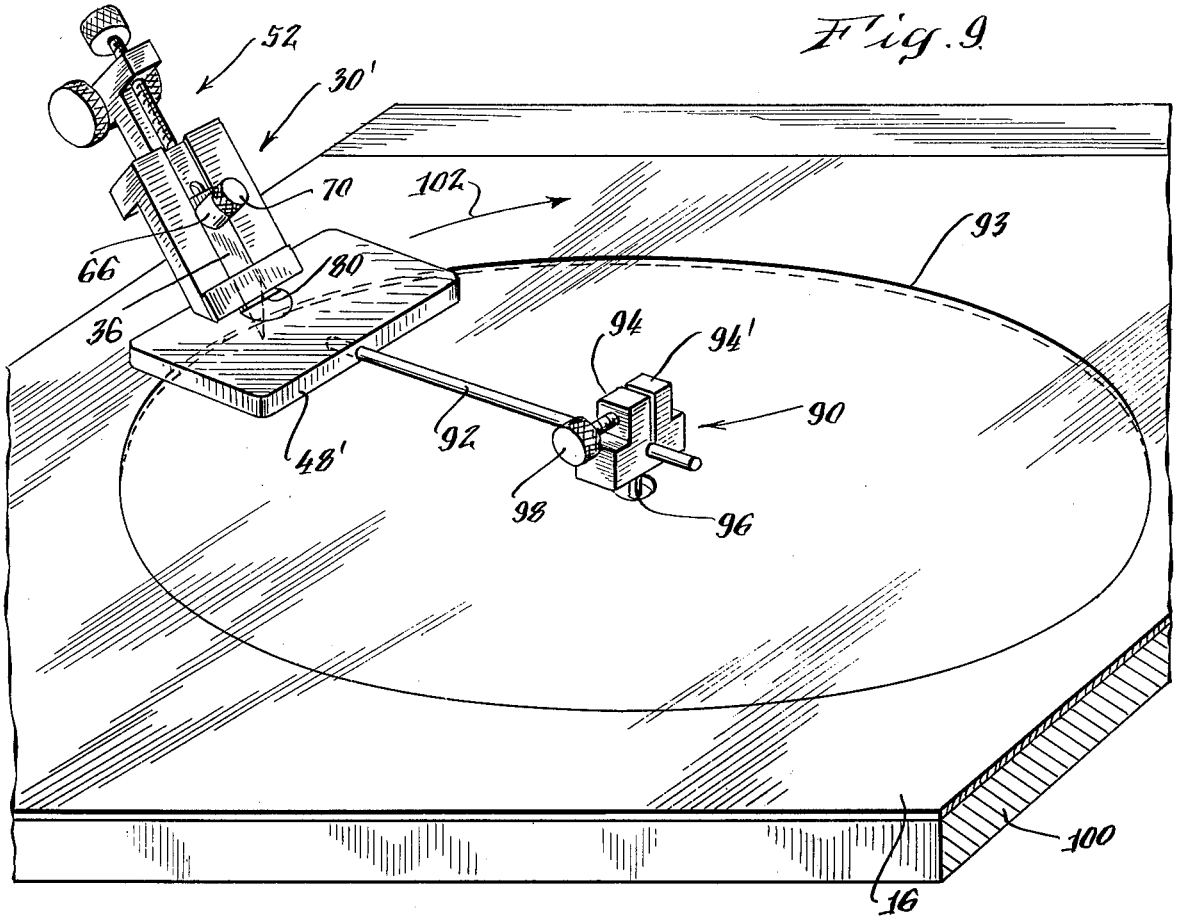
FIG. 9 is a perspective view of an angle cutting apparatus employed in forming a beveled circle cut in a mat.
Figure 10:
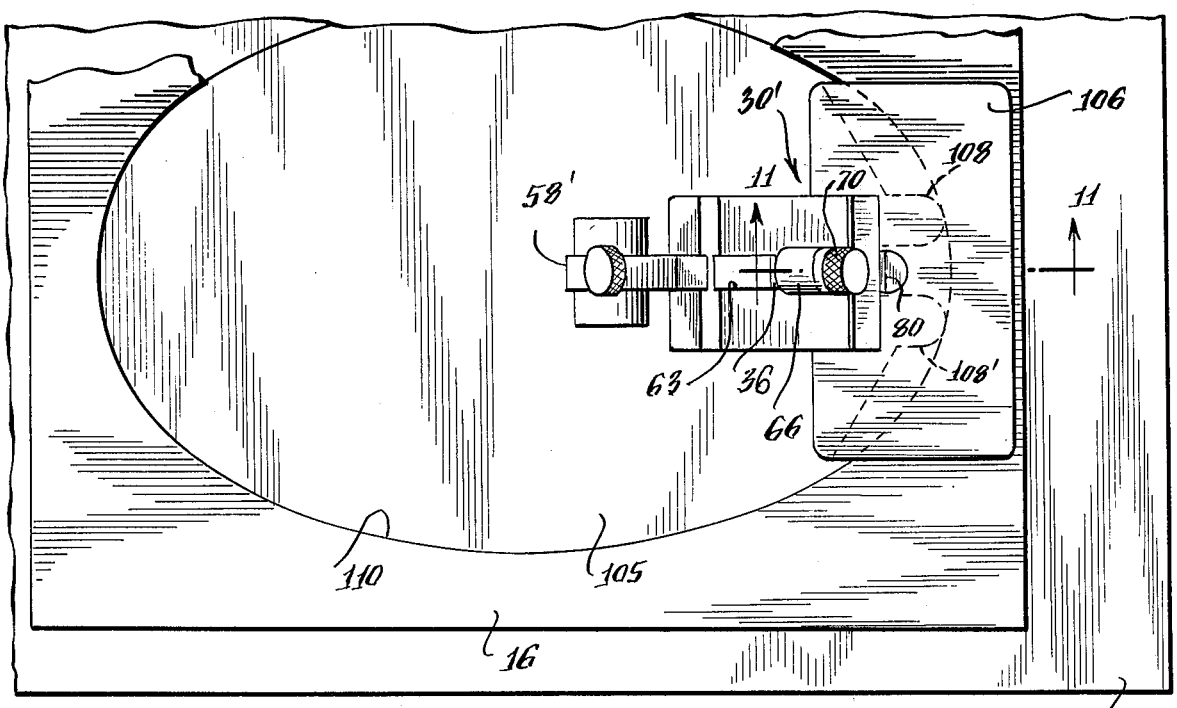
FIG. 10 is a plan view of still another angle cutting block for forming a mat cut of an irregular shape as defined by a template.

A cutter block in accordance with the invention may be conveniently employed to form unusual cut-outs from mats as illustrated with the apparatus shown in FIGS. 9 and 10. In FIG. 9 the angle cutting block 30′ is shown mounted to a central retainer 90 with a rod 92 to make a circular cut-out 93. The rod 92 is threaded into a corresponding horizontal hole in the cutter base 48′ and engages pivotally supported retainer 90. The retainer 90, as illustrated, may be formed with a pair of bottom joined clamping elements 94, 94′ which are supported for rotation by a central stud 96. A thumb screw 98 extends through clamp element 94 to engage a threaded hole in clamp 94. Rotation of screw 98 controls the grip on rod 92 at its desired radial position.

In FIG. 9 a mat 16 to be cut is located on a suitable board 100 to which mat 16 may be mounted with suitable clamps (not shown). Stud 96 is driven through the mat 16 to either penetrate a corresponding hole in board 100 or, if the latter is formed of soft material, into a new hole formed as the stud 96 is applied. Once the stud 96 has engaged with the underlying board 100, the angle cutter 30' may be employed by plunging the knife assembly 52 towards the mat 16 and rotating the cutter block around its pivot formed by stud 96 in the direction of arrow 102. As shown, a circular cut 93 may thus be formed in mat 16.

Figure 11:
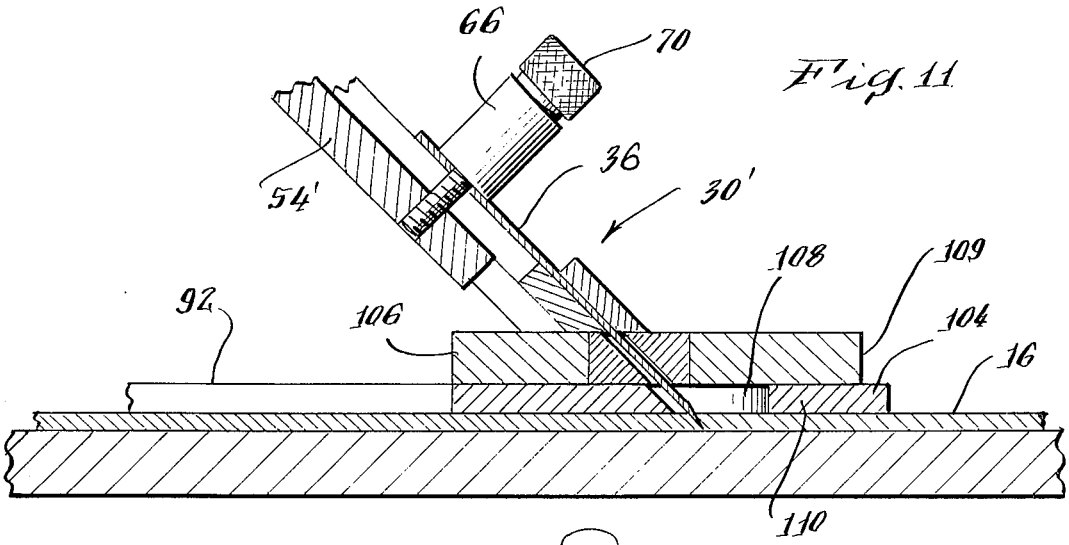
FIG. 11 is a vertical section view of the angle cutting block shown in FIG. 10.

In the embodiment of FIGS. 10 and 11 a template 104 having an oval cut-out 105 is employed in conjunction with a cutter block 30' using a modified cutter base 106. In this instance the cutter base 106 is provided with downwardly projecting round guide edges 108, 108' on both sides of the cutter blade 36. Guide edges 108 terminate short of side 109 of cutter base 106 to define a recess into which side 110 of cut-out 105 can fit as shown in FIG. 11. Guide edges 108 are sized to follow the side 110 of the cut-out 105 in template 104. A manual movement of the cutter block 30' with the edges 108 pressed against side 110 enables the formation of an oval cut. Other cut-out shapes can be formed with differently shaped templates.

Figure 12:
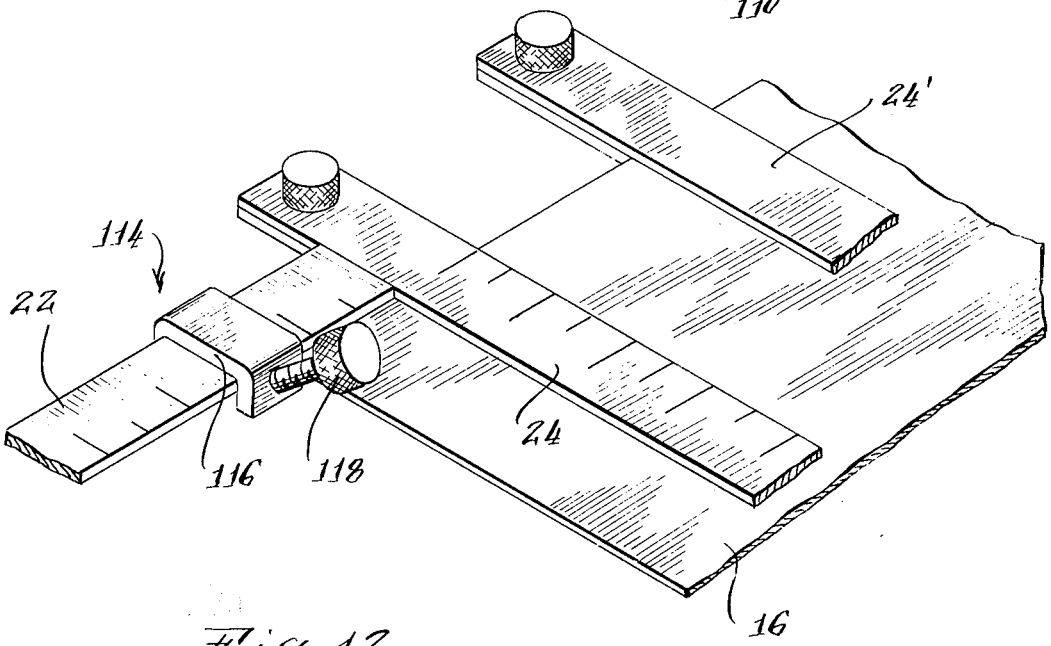
FIG. 12 is a perspective view of a stop for use with a lateral scale used on the mat cutting apparatus shown in FIG. 1.

In FIG. 12 an additional stop element 114 is shown mounted on lateral scale 22. The stop element 114 is formed of a generally U-shaped bracket 116 which has a suitably located threaded hole for engagement by a thumb screw 118. The latter, when engaged with the hole, enables the stop element 114 to be firmly connected to the lateral scale 22 at a desired location to thus control the lateral position of mat 16.

Having thus described a mat cutting apparatus in accordance with the invention, its advantages can be apppreciated. The use of parallel spaced guide bars enables use of different accessories for the cutting of a mat. For example, a suitable drafting element may be used between the guide bars 24 with appropriate holes or grooves to draw lines on the back of a mat to determine the desired location for a cut. Accordingly, variations of the described embodiment may be made without departing from the scope of the invention.

What is claimed is:

1. A mat cutting apparatus comprising a cutting board to support a mat to be cut on a surface of the board, said cutting board being provided with a pair of parallel longitudinal guide bars affixed to and spaced above the cutting board to enable a mat to fit between the guide bars and said cutting board surface, said parallel guide bars being selectively laterally spaced from each other to form lateral guide surfaces for a mat cutting block adapted to snugly fit between the guide bars for longitudinal movement along the guide bars, and cutting board further having a groove parallel to and located between the guide bars to receive a knife edge protruding from the mat cutting block; and a mat cutting block formed with a guide block and a knife assembly movably mounted to the guide block for movement from a retracted position to a mat cutting position, said guide block being formed with a cutter base having a flat surface for planar movement across a mat to be cut and being sized to snugly fit and slide between the guide bars.

2. The mat cutting apparatus as claimed in claim 1 wherein the baseboard is further provided with a lateral scale mounted on the cutting board and laterally oriented transverse to the guide bars, said scale bar providing a stop surface for retaining and locating a mat to be cut, said scale bar having a scale whose indicia are referred to the location of the knife assembly of the cutter block when it is operatively mounted between the guide bars one of said guide bars further having a scale referenced with respect to the stop surface of the lateral scale bar; and a plurality of clamps mounted on the cutting board and disposed along the scale bar to retain a mat in a desired cutting position on the cutting board.

3. A mat cutting apparatus as claimed in claim 2 wherein the cutting board is still further provided with an end scale bar movably mounted to the cutting board between the guide bars.

4. The mat cutting apparatus as claimed in claim 1 wherein the guide block further includes a transparent cutter base having a flat undersurface for movement over a mat, said cutter base having an opening sized to enable the knife edge to protrude to cut a mat.

5. The mat cutting apparatus as claimed in claim 4 wherein the guide block further includes a knife guide plate affixed to the guide block and extending upwardly therefrom to form a knife guiding surface for the knife assembly.

6. The mat cutting apparatus as claimed in claim 5 wherein the knife guide plate has a motion limiting slot and the knife assembly is formed with an extension slidably engaging to one side of the knife guide plate, and a knife slidably attached to an opposite side of the knife guide plate in alignment with the opening in the cutter base, said guide block and knife being connected to each other through said motion limiting slot.

7. A cutting block for use with a mat cutting apparatus formed with a cutting board and a pair of guide bars mounted in parallel on the cutting board with a predetermined spacing between them comprising a guide block formed of a cutter base having a generally flat underside adapted fo form a flush contact with a mat to be cut and sized to snugly fit between said guide bars, and a knife guide plate affixed to the cutter base and extending upwardly therefrom; and a knife assembly movably mounted to the knife guide plate, said knife assembly being mounted for sliding movement between retracted position and cutting position on the knife guide plate.

8. The cutting block as claimed in claim 7 wherein the knife assembly is formed of a actuator and a knife attached thereto, said knife and actuator being located on opposite sides of the knife guide plate.

9. The cutting block as claimed in claim 8 wherein the knife guide plate is provided with a motion limiting slot, with said knife and actuator being connected to each other through said slsot.

10. The cutting block as claimed in claim 9 wherein the knife guide plate is provided with a recess shaped to retain the knife in snug sliding relationship in an orientation selected to support the knife in a desired mat cutting position.

11. The cutting block as claimed in claim 7 wherein the cutter base is provided with a generally centrally located base slot and wherein said knife assembly is located to operate through said base slot.

12. The cutting block as claimed in claim 7 wherein the cutter base is transparent to expose an underlying working surface.

13. The cutting block as claimed in claim 12 wherein the cutter base is provided with visual alignment lines aligned to visually designate the operative cutting position of the knife assembly.

14. The cutting block as claimed in claim 7 and further including an adjustable stop element located on the knife assembly to engage a surface on the guide block when the knife assembly is moved to an operative cutting position, said stop element being adjustable to control the depth of penetration of the knife assembly into a mat to be cut.

15. The cutting block as claimed in claim 7 wherein the knife assembly includes a knife and means for releasably retaining the knife in flush mounting relationship with the guide block.

16. The cutting block as claimed in claim 15 wherein the knife guide plate is provided with a recess shaped to retain the knife in flush mounting relationship, said recess having an edge located to provide edge support to the knife for a cutting operation.

17. A cutting block for use with a mat cutting apparatus formed with a template having a cut-out terminating at an edge, comprising a guide block formed of a cutter base having a generally flat underside adapted to form a flush contact with a mat to be cut, and a knife guide plate affixed to the cutter base and extending upwardly therefrom; and a knife assembly including a knife and movably mounted to the knife guide plate, said knife assembly being mounted for sliding movement between a retracted position and a knife cutting position on the knife guide plate;

said cutter base underside further terminating at a pair of rounded guide edges terminating short of a side of the cutter base to define a recess shaped to receive the side of the cut-out in the template and enable movement of the cutter base around the cut-out side, with said rounded guide edges respectively located on opposite sides of the knife in its cutting position.

* * * * *

UNITED STATES PATENT OFFICE

CERTIFICATE OF CORRECTION

PATENT NO. : 3,964,360

DATED : June 22, 1976

INVENTOR(S) : Joseph Schwartz

It is certified that error appears in the above-identified patent and that said Letters Patent are hereby corrected as shown below:

Col. 3, line 30, "gars" should be --bars--.

Col. 3, line 40,"36" should be --37--.

Col. 3, line 42, "36" should be --37--.

Col. 3, line 45, "36" should be --37--.

Col. 3, line 50, "36" should be --37--.

Col. 3, line 51, "36" should be --37--.

Col. 4, line 20, "n" should be --in--.

Col. 5, line 55, "and" should be --said--.

Col. 6, line 42, "fo" should be --to--.

Col. 8, line 20, "edges" should be --edges being--.

Signed and Sealed this

Second Day of November 1976

[SEAL]

*Attest:*

RUTH C. MASON
*Attesting Officer*

C. MARSHALL DANN
*Commissioner of Patents and Trademarks*